United States Patent [19]

Gwilt

[11] 4,198,922

[45] Apr. 22, 1980

[54] GAS BARRIER COATING CONTROL APPARATUS WITH A READILY REPLACEABLE GAS ORIFICE HEADER SEGMENT

[75] Inventor: Charles W. Gwilt, Oakley, Calif.

[73] Assignee: United States Steel Corporation, Pittsburgh, Pa.

[21] Appl. No.: 950,509

[22] Filed: Oct. 10, 1978

[51] Int. Cl.[2] ..... B05C 11/06

[52] U.S. Cl. ..... 118/63; 427/348; 427/349

[58] Field of Search ..... 118/63; 427/348, 349

[56] References Cited

U.S. PATENT DOCUMENTS

| | | | |
|---|---|---|---|
| 1,580,888 | 4/1926 | Herman | 118/63 |
| 2,084,150 | 6/1937 | Lawrence | 118/63 |
| 2,981,223 | 4/1961 | Olszowka | 118/63 |
| 3,113,791 | 12/1963 | Frost et al. | 285/112 |
| 3,272,176 | 9/1966 | Saydlowski | 118/63 |
| 3,459,587 | 8/1969 | Hunter et al. | 118/63 X |
| 3,670,695 | 6/1972 | Patterson | 118/63 |
| 3,687,103 | 8/1972 | LaCamera et al. | 118/63 |
| 3,841,557 | 10/1972 | Atkinson | 118/63 X |
| 3,932,683 | 1/1976 | Robins et al. | 427/349 |
| 3,938,468 | 2/1976 | Kirschner | 118/63 |

*Primary Examiner*—James R. Hoffman

*Attorney, Agent, or Firm*—William F. Riesmeyer

[57] ABSTRACT

An improved gas barrier assembly for controlling coating thickness on a strip, has a header which comprises abutting length segments including a pair of conduit segments fixed to a frame in spaced apart position and an intermediate gas orifice segment located therebetween mating in end-to-end relationship with said conduit segments and a readily releasable connecting means for fastening the intermediate gas orifice segment to each of the conduits in gas tight relationship, said connecting means including means for supporting the intermediate gas orifice segment when the connecting means are unfastened so that it may be removed and replaced easily without removing the frame from the coating line.

3 Claims, 6 Drawing Figures

GAS BARRIER COATING CONTROL APPARATUS WITH A READILY REPLACEABLE GAS ORIFICE HEADER SEGMENT

BACKGROUND OF THE INVENTION

In processes for coating a strip with liquid coating material, a gas barrier assembly is often used to wipe off the excess coating and thereby control the thickness of coating remaining on the strip. The assembly includes a header with a gas barrier orifice; a frame structure for supporting the header in position adjacent to the strip, and a gas supply connected to the header. Recently, the orifice of the header has been designed with a curved lip configuration so that more uniform coating thickness is obtained across the strip width. U.S. Pat. No. 3,670,695 may be referred to for a showing of such a header. A particular curved lip configuration provides a optimum results however, for only a limited range of strip widths. Therefore, it is desirable to change to a header having a different lip configuration when strip outside a certain width range is to be coated.

Changing headers in present gas barrier assemblies is time consuming and causes substantial loss of production on the coating line because the change requires removing the entire frame containing the headers from the coating line, and moving it to a maintenance area. All electrical and piping connections must of course be disconnected before the frame can be moved. At the maintenance area the header is removed from the frame and a replacement installed. The frame is then transported back to the line, and the various electrical and piping connections made. This whole operation usually requires 2 to 3 hours or more overall.

Of course at times it is necessary to change headers, for maintenance purposes, such as when dirt gets into the system and clogs the orifice or when other problems occur. Header changes in these situations also require the same time consuming steps on present equipment and therefore also cause substantial loss of production.

SUMMARY OF THE INVENTION

According to this invention an improvement is provided in conventional gas barrier coating control apparatus for a strip coating line. In conventional apparatus an elongated header is provided which has an axial bore and a gas orifice communicating with the bore to emit gas against the coated strip wiping excess coating therefrom. A source is also provided for supplying gas to each end of the header, with the header being mounted in a frame which supports the header in a proper position for emitting gas against the coated strip. The improved apparatus includes a header divided into abutting length segments. The segments include a pair of conduits secured to the frame in fixed position spaced apart from each other, and an intermediate gas orifice segment located between the conduits and mating in end-to-end relationship with each of them. A readily releaseable connecting means is attached to each conduit segment adjacent an end of the intermediate gas orifice segment for fastening said segments in gas tight relationship. Each connecting means includes means for supporting the intermediate gas orifice segment when the connecting means are unfastened, thus permitting replacement of the intermediate segment without removing the frame from the coating line.

It is a primary object of this invention to provide an improved gas barrier coating control apparatus which facilitates replacement of a header segment containing the gas orifice without requiring removal of the frame in which said header is supported, from the coating line.

This and other objects of the invention will become more apparent from a reading of the following detailed description when taken in conjunction with the appended claims and drawings, in which:

PRIOR ART

Figure 1:
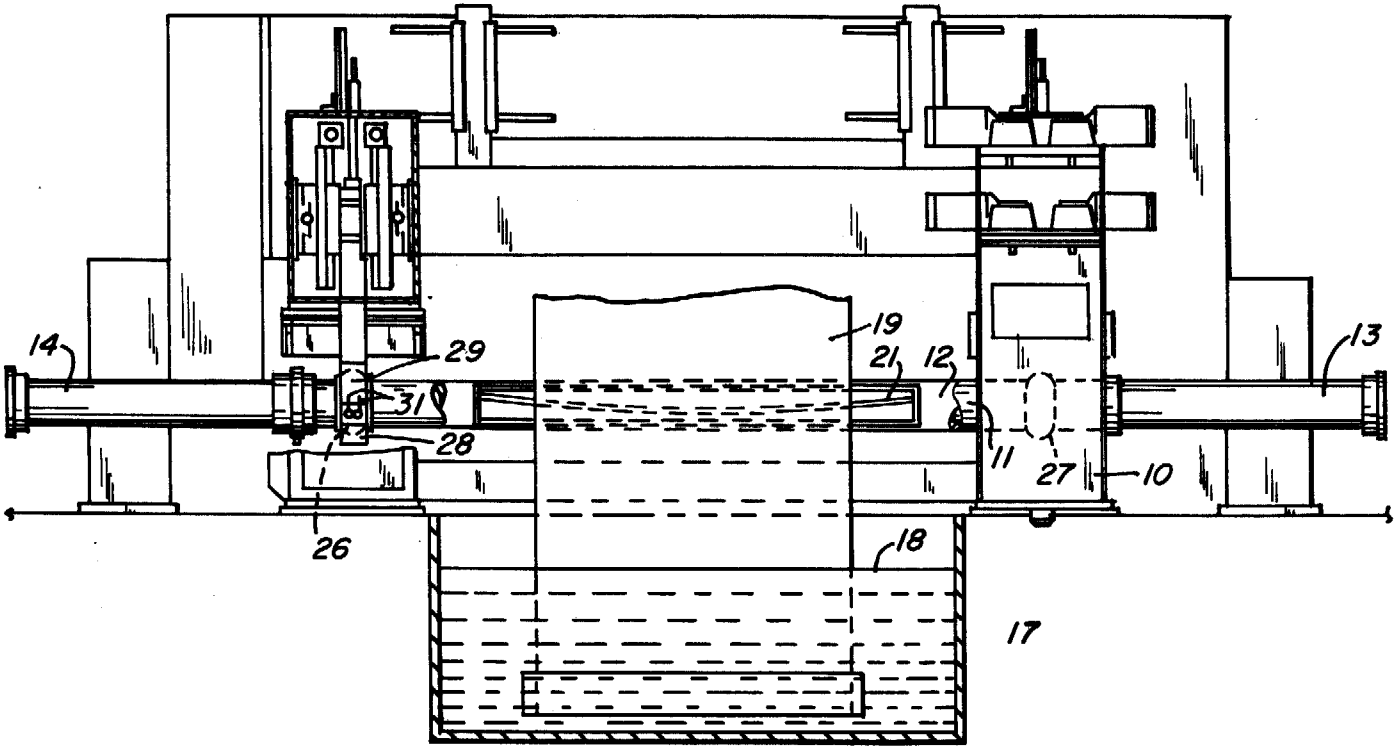
FIG. 1 (PRIOR ART)
FIG. 1 is a front elevation of the prior art gas barrier assembly.
Figure 2:
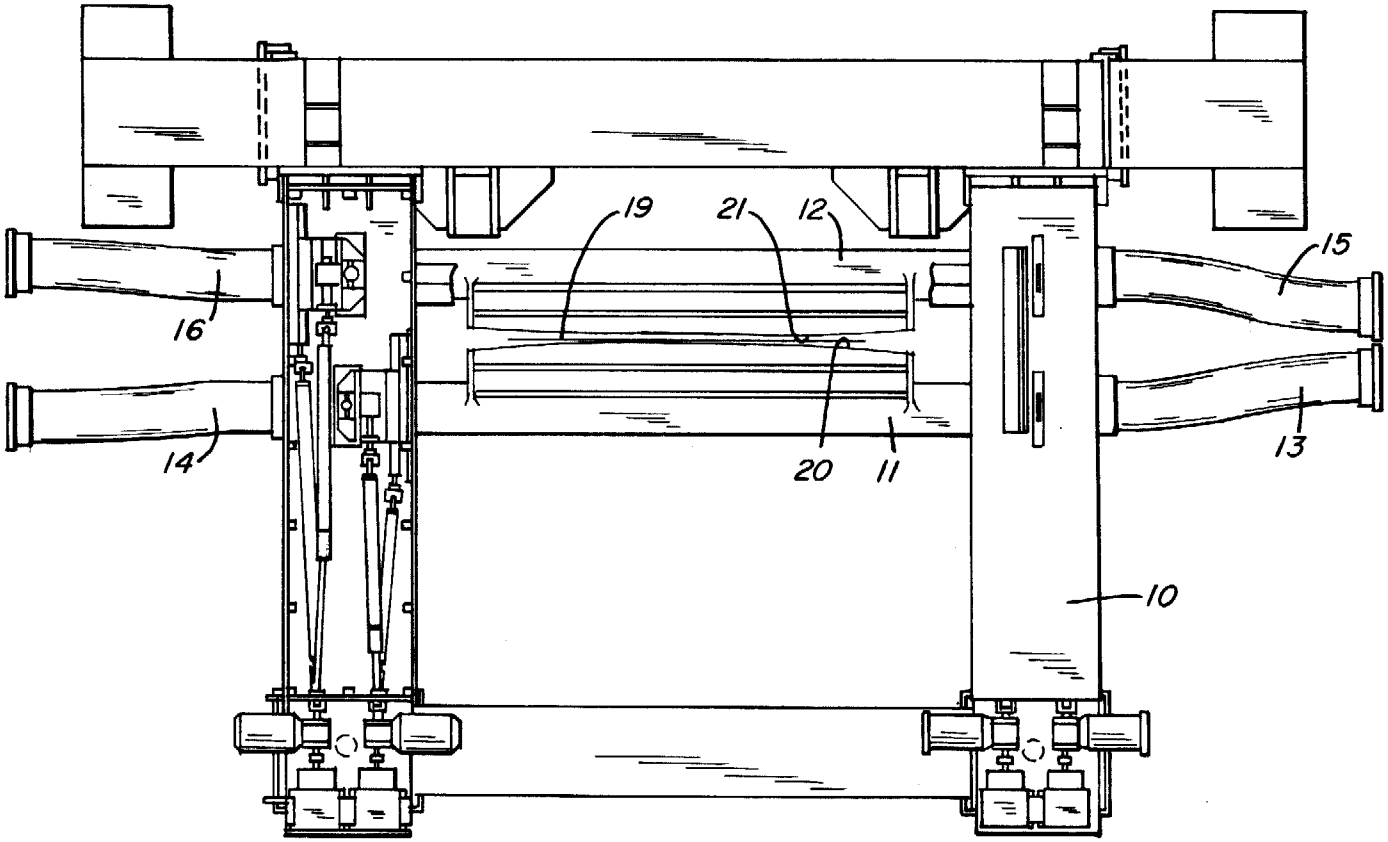
FIG. 2 (PRIOR ART)
FIG. 2 is a plan view of the apparatus shown in FIG. 1.

Although more broadly applicable, the invention will be described as applied in the hot dip galvanizing of steel strip. The gas barrier assembly includes a frame 10 which (FIGS. 1 and 2) supports headers 11, 12 and a source of gas connected to said headers by flexible hoses 13, 14, 15 and 16. The frame is located over pot 17 containing liquid coating material 18, in this case molten zinc, so that as strip 19 emerges from the pot it passes between the headers. Gas emitted from the curved lip orifices 20, 21 impinges upon opposite surfaces of the strip to wipe excess liquid coating therefrom before said coating solidifies on the strip.

The opposite ends of each header are secured in the frame. Each of the header ends has a respective ball joint assembly 26, 27 (FIG. 1) which is encased in half-circle caps 28, 29 secured by bolts 31. In order to remove the headers from the frame it is necessary to lift the entire frame containing the headers by a crane and move it to a maintenance area away from the coating pot. To do this of course, first requires disconnection of flexible hoses 13, 14, 15 and 16 as well as all electrical connections to the frame for operating the headers. In addition, it is also necessary to cut the galvanized strip in the line. After the frame is at the separate maintenance area, a fork lift truck or other support means is moved underneath the headers prior to their disconnection from the frame. Then, bolts 31 may be removed to unfasten the removable lower caps 28 from each respective ball joint assembly so that the headers may be removed from the frame.

DESCRIPTION OF THE PREFERRED EMBODIMENT

Figure 3:
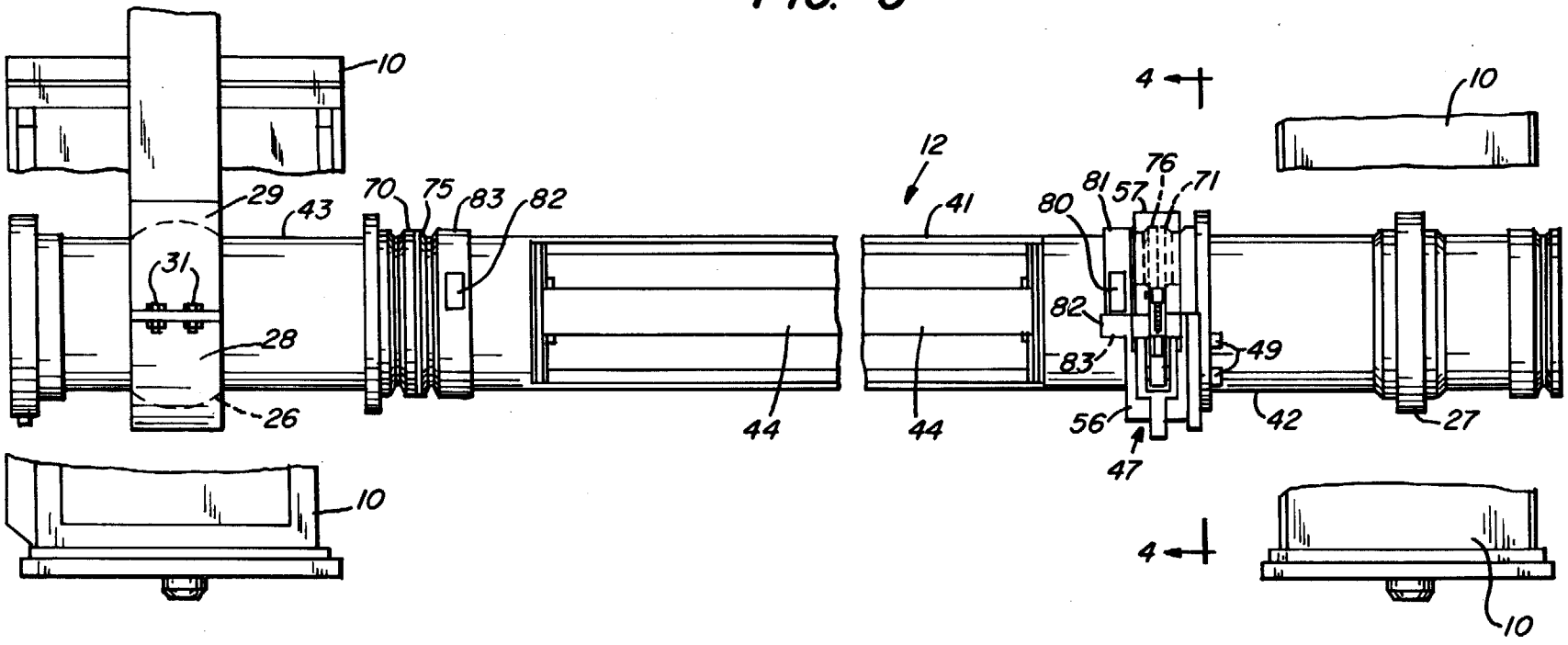
FIG. 3 is an enlarged front elevation of one header illustrating the improved gas barrier assembly of this invention.

Referring to FIG. 3, the improved apparatus of this invention includes a header 12 which comprises abutting length segments including an intermediate gas orifice segment 41 and a pair of conduit segments 42, 43 each mating in end-to-end relationship with an opposite end of said intermediate segment. The intermediate segment is that portion of the length of the header which fully includes the gas barrier orifice 44 for directing a stream of gas against the strip to control the thickness of coating thereon. Conduit segments 42, 43 for conveying gas from a supply to the intermediate segment are secured to frame 10 in conventional fashion which as shown may be by half-circle caps 28, 29 which fit over the respective ball joint assemblies 26, 27. Readily releasable connecting means are provided for fastening the intermediate gas orifice segment to mating ends of each conduit segment to make a gas tight seal therebetween. One of said connecting means is shown at 47 (FIG. 3), the other at the opposite end of the intermediate segment being removed. The connecting means as hereinafter more specifcially described also include means supporting the intermediate segment when said readily releasable connecting means are unfastened. Thus, the intermediate segment may be removed and replaced without moving the frame from its position at the coating line. This is of particular advantage and facilitates removal and replacement of headers so as to minimize downtime and loss of production.

Figure 6:
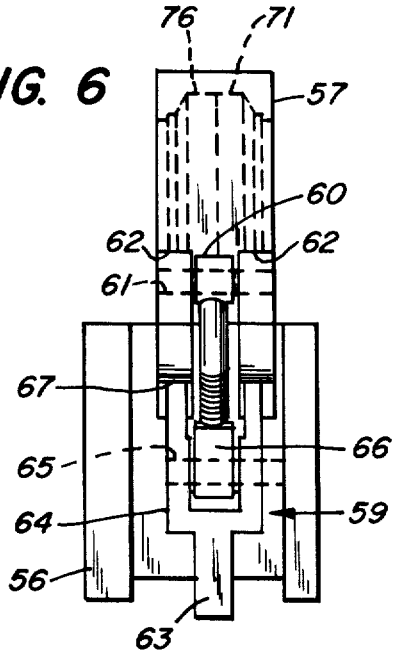
FIG. 6 is an end view of the apparatus of FIG. 4.
Figure 4:
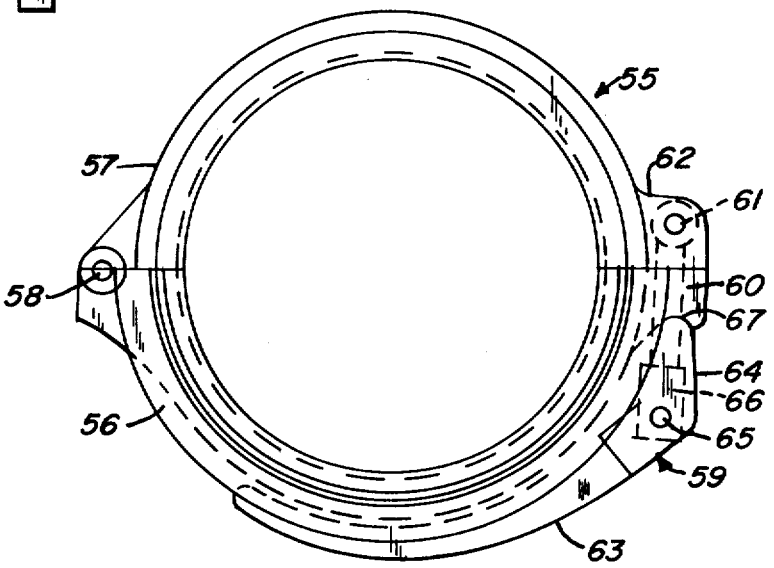
FIG. 4 is an enlarged side view of the means for fastening mating ends of the intermediate gas orifice segment and the conduits at 4—4 of FIG. 3.
Figure 5:
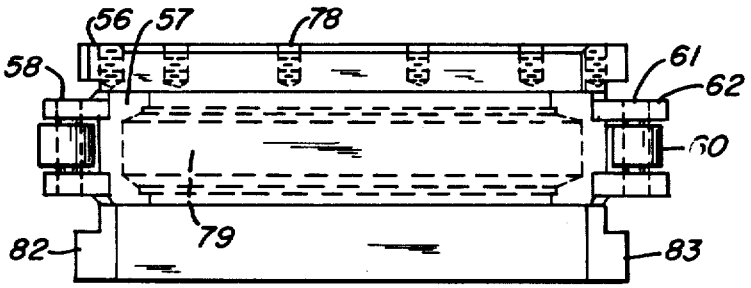
FIG. 5 is a top view of the apparatus of FIG. 4.

Referring now to FIGS. 4, 5 and 6 each readily releasable connecting means 47, 48 preferably has a lower half-peripheral section 56, an upper half-peripheral section 57 pivotably connected to the lower section by pin 58, and a locking means 59 which includes arm 60 pivotably mounted by pin 61 in clevis 62 of upper half-peripheral section 57, and locking latch 63 pivotably attached at clevis 64 by pin 65 to arm 60 which is connected to a separate threaded cap 66 for receiving pin 65. Locking means 59 has a curvature at clevis 64 engageable in the mating curvature of end 67 of lower section 56 so as to provide locking engagement holding the two half-peripheral sections together.

Also in the preferred form, the mating end of each conduit segment 42, 43 (of FIG. 3) has an integral or separately attached flanged end 70, 71 (FIG. 3). Flanged ends 70, 71 have a plurality of holes spaced around the bottom portion of their periphery in which cap screws 49 are inserted and are engageable in threaded holes spread around the bottom portion of peripheral section 56 of the clamping means as shown in FIG. 5 at 78. The flanges of each conduit segment mate with flanges of ends 75, 76 (FIG. 3) integral with or attached to intermediate segment 41. The mating flanges of the intermediate and conduit segments fit into circumferential grooves 79 machined to close tolerance in half-peripheral sections 56, 57 (FIG. 5), thereby furnishing a gas tight seal when said sections are locked together over the flanges 70, 75 or 71, 76. In this preferred form since the lower half-peripheral section 56 of each connecting means are secured to the conduit segments by cap screws 49 they serve as means for supporting the intermediate segment when the readily releasable connecting means are unfastened.

Also in the preferred form alignment means is provided for guiding the intermediate segment into proper rotational alignment about its axis with respect to the conduit segments when the intermediate segment is being installed. An alignment means is provided near each end of the intermediate segment in the form of a pair of guide blocks 80, 81 (FIG. 3). A cooperating alignment means is provided on the lower half-peripheral section in the form of a pair of guide blocks 82, 83 (FIGS. 3, 5). This assures proper alignment of the intermediate gas orifice segment 41 with respect to the conduit segments 42, 43 so that the relationship of intermediate gas orifice segment 41 to the computer set timing gear (not shown) located within ball joint 27 is not disturbed. Thus the newly installed intermediate segment will be in precisely the same mode as the previous one.

I claim:

1. In a gas barrier coating control apparatus for a strip coating line, said apparatus including an elongated header having an axial bore therethrough and a gas orifice communicating with said bore, a source for supplying gas to each end of said header, and a frame for supporting said header in position in the coating line for properly controlling the coating on the strip, the improvement in said apparatus which comprises:

(a) said header comprising abutting length segments including a pair of conduit segments secured to the frame in fixed position spaced from each other and an intermediate gas orifice segment located therebetween mating in end-to-end relationship with each of said conduit segments; and (b) a readily releaseable connecting means attached to each conduit segment for fastening the adjacent end of said intermediate segment thereto in gas tight relationship, including means for supporting said intermediate segment when the connecting means are unfastened, said connecting means permitting replacement of the intermediate segment without removing the frame from the coating line.

2. The apparatus of claim 1 wherein said connecting means comprises a coupling including a lower half-peripheral section, an upper half-peripheral section pivotally attached to said lower section, and a locking means for fastening said half-peripheral sections together, said lower half-peripheral section being secured to the conduit segment for supporting the intermediate segment when the connecting means is unfastened.

3. The apparatus of claim 2 further comprising an alignment means near each end of said intermediate segment, and cooperating alignment means on the lower half-peripheral section of each coupling for guiding the intermediate segment during installation thereof into proper rotational alignment about its axis with respect to the conduit segments.

* * * * *